US005715362A

United States Patent [19]

Vänskä

[11] Patent Number: 5,715,362

[45] Date of Patent: Feb. 3, 1998

[54] METHOD OF TRANSMITTING AND RECEIVING CODED SPEECH

[75] Inventor: Marko Vänskä, Nummela, Finland

[73] Assignee: Nokia Telecommunications Oy, Espoo, Finland

[21] Appl. No.: 313,253

[22] PCT Filed: Feb. 3, 1994

[86] PCT No.: PCT/EI94/00051

§ 371 Date: Oct. 4, 1994

§ 102(e) Date: Oct. 4, 1994

[87] PCT Pub. No.: WO94/18668

PCT Pub. Date: Aug. 18, 1994

[30] Foreign Application Priority Data

Feb. 4, 1993 [FI] Finland ..... 930493

[51] Int. Cl.[6] ..... G10L 3/02; G10L 9/00; G10L 5/02

[52] U.S. Cl. ..... 395/2.1; 395/2.7

[58] Field of Search ..... 395/2.1, 2.3, 2.52, 395/2.53, 2.54, 2.7, 2.4, 2.45, 2.75; 381/50, 53

[56] References Cited

U.S. PATENT DOCUMENTS 5,121,434 6/1992 Mrayati et al. ..... 395/2.7
5,165,008 11/1992 Hermansky et al. ..... 395/2

FOREIGN PATENT DOCUMENTS 92 20064 11/1992 WIPO ..... G10L 9/10
94 02936 2/1994 WIPO ..... G10L 5/06

*Primary Examiner*—Allen R. MacDonald
*Assistant Examiner*—Patrick N. Edouard
*Attorney, Agent, or Firm*—Cushman Darby & Cushman Intellectual Property Group of Pillsbury Madison & Sutro LLP

[57] ABSTRACT

A method of transmitting and receiving coded speech, in which method samples are taken of a speech signal and reflection coefficients are calculated from these samples. In order to minimize the used transmission rate, characteristics of the reflection coefficients are compared with respective stored sound-specific characteristics of the reflection coefficients for the identification of the sounds, and identifiers of identified sounds are transmitted, speaker-specific characteristics are calculated for the reflection coefficients representing the same sound and stored in a memory, the calculated characteristics of the reflection coefficients representing said sound and stored in the memory are compared with the following characteristics of the reflection coefficients representing the same sound, and if the following characteristics of the reflection coefficients representing the same sound do not essentially differ from the characteristics of the reflection coefficients stored in the memory, differences between the characteristics of the reflection coefficients representing the same sound of the speaker and the characteristics of the reflection coefficients calculated from the previous sample are calculated and transmitted.

2 Claims, 6 Drawing Sheets

FIG. 6

METHOD OF TRANSMITTING AND RECEIVING CODED SPEECH

A method of transmitting and receiving coded speech

FIELD OF THE INVENTION

The invention relates to a method of transmitting coded speech, in which method samples are taken of a speech signal and reflection coefficients are calculated from these samples.

The invention relates also to a method of receiving coded speech.

BACKGROUND OF THE INVENTION

In telecommunication systems, especially on the radio path of radio telephone systems, such as GSM system, it is known that a speech signal entering the system and to be transmitted is preprocessed, i.e. filtered and converted into digital form. In known systems the signal is then coded by a suitable coding method, e.g. by the LTP (Long Term Prediction) or RPE (Regular Pulse Excitation) method. The GSM system typically uses a combination of these, i.e. the RPE-LTP method, which is described in detail e.g. in "M. Mouly and M. B. Paute, The GSM System for Mobile Communications, 1992, 49, rue PALAISEAU F-91120, pages 155 to 162". These methods are described in more detail in the GSM Specification "GSM 06.10, January 1990, GSM Full Rate Speech Transcoding, ETSI, 93 pages".

A drawback of the known techniques is the fact that the coding methods used require plenty of transmission capacity. When using these methods according to the prior art, the speech signal to be transmitted to the receiver has to be transmitted entirely, whereby transmission capacity is unnecessarily wasted.

SUMMARY OF THE INVENTION

The object of this invention is to offer such a speech coding method for transmitting data in telecommunication systems by which the transmission speed required for speech transmission may be lowered and/or the required transmission capacity may be reduced.

This novel method of transmitting coded speech is provided by means of the method of the invention, which is characterized in that characteristics of the reflection coefficients are compared with respective sound-specific characteristics of the reflection coefficients of at least one previous speaker for the identification of the sounds and identifiers of the identified sounds are transmitted, speaker-specific characteristics are calculated for the reflection coefficients representing the same sound and stored in a memory, the calculated characteristics of the reflection coefficients representing the same sound and stored in the memory are compared with the following characteristics of the reflection coefficients representing the same sound, and if the following characteristics of the reflection coefficients representing the same sound differ essentially from the characteristics of the reflection coefficients stored in the memory, the new characteristics representing the same sound are stored in the memory and transmitted, and before transmitting them, information is sent of the transmission of these characteristics and if the following characteristics of the reflection coefficients representing the same sound do not essentially differ from the characteristics of the reflection coefficients stored in the memory, differences between the characteristics of the reflection coefficients representing the same sound of the speaker and the characteristics of the reflection coefficients calculated from the previous sample are calculated and transmitted.

The invention relates further to a method of receiving coded speech, which method is characterized in that an identifier of an identified sound is received, differences between characteristics of the stored sound-specific reflection coefficients of one previous speaker and characteristics of the reflection coefficients calculated from samples are received, the speaker-specific characteristics of the reflection coefficients corresponding to the received sound identifier are searched for in a memory and added to the differences, and from this sum are calculated new reflection coefficients used for sound production, and if information of a transmission of new characteristics sent by a communications transmitter as well as new characteristics of the reflection coefficients representing the same sound sent by another communications transmitter are received, these new characteristics are stored in the memory.

The invention is based on the idea that, for a transmission, a speech signal is analyzed by means of the LPC (Linear Prediction Coding) method, and a set of parameters, typically characteristics of reflection coefficients, modelling a speaker's vocal tract is created for the speech signal to be transmitted. According to the invention, sounds are then identified from the speech to be transmitted by comparing the reflection coefficients of the speech to be transmitted with several speakers' respective previously received reflection coefficients calculated for the same sound. After this, reflection coefficients and some characteristics therefor are calculated for each sound of the speaker concerned. Characteristic may be a number representing physical dimensions of a lossless tube modelling the speaker's vocal tract. Subsequently, from these characteristics are substracted the characteristics of the reflection coefficients corresponding to each sound, providing a difference, which is transmitted to the receiver together with an identifier of the sound. Before that, information of the characteristics of the reflection coefficients corresponding to each sound identifier has been transmitted to the receiver, and therefore, the original sound may be reproduced by summing said difference and the previously received characteristic of the reflection coefficients, and thus, the amount of information on the transmission path decreases.

Such a method of transmitting and receiving coded speech has the advantage that less transmission capacity is needed on the transmission path, because all of each speaker's voice properties need not be transmitted, but it is enough to transmit the identifier of each sound of the speaker and the deviation by which each separate sound of the speaker deviates from a property, typically an average, of some characteristic of the previous reflection coefficients of each sound of the respective speaker. By means of the invention, it is thus possible to reduce the transmission capacity needed for speech transmission by approximately 10% in total, which is a considerable amount.

In addition, the invention may be used for recognizing the speaker in such a way that some characteristic, for instance an average, of the speaker's sound-specific reflection coefficients is stored in a memory in advance, and the speaker is then recognized, if desired, by comparing the characteristics of the reflection coefficients of some sound of the speaker with said characteristic calculated in advance.

Cross-sectional areas of cylinder portions of a lossless tube model used in the invention may he calculated easily from so-called reflection coefficients produced in conventional speech coding algorithms. Also some other cross-sectional dimension, such as radius or diameter, may naturally he determined from the area to constitute a reference parameter. On the other hand, instead of being circular the cross-section of the tube may also have some other shape.

BRIEF DESCRIPTION OF THE DRAWINGS

In the following, the invention will be described in more detail with reference to the attached drawings, in which.

DETAILED DESCRIPTION OF PREFERRED EMBODIMENTS OF THE INVENTION

Figure 1:
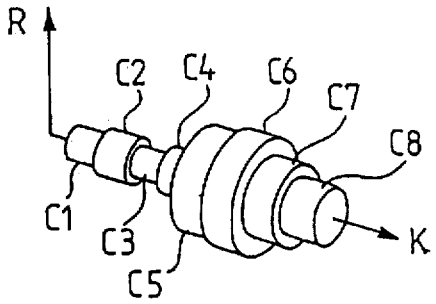
FIGS. 1 and 2 illustrate a model of a speaker's vocal tract by means of a lossless tube comprising successive cylinder portions.
Figure 2:
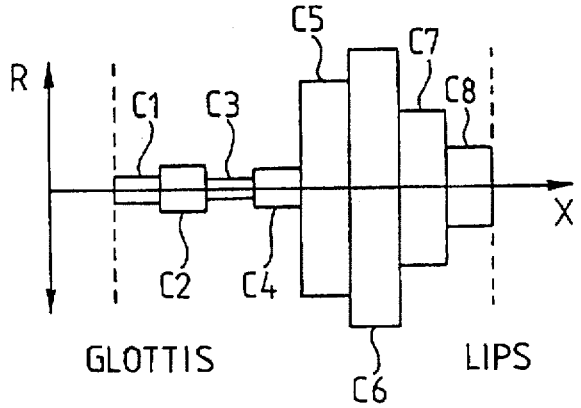

Reference is now made to FIG. 1 showing a perspective view of a lossless tube model comprising successive cylinder portions C1 to C8 and constituting a rough model of a human vocal tract. The lossless tube model of FIG. 1 can be seen in side view in FIG. 2. The human vocal tract generally refers to a vocal passage defined by the human vocal cords, the larynx, the mouth of pharynx and the lips, by means of which tract a person produces speech sounds. In the FIGS. 1 and 2, the cylinder portion C1 illustrates the shape of a vocal tract portion immediately after the glottis between the vocal cords, the cylinder portion C8 illustrates the shape of the vocal tract at the lips and the cylinder portions C2 to C7 inbetween illustrate the shape of the discrete vocal tract portions between the glottis and the lips. The shape of the vocal tract typically varies continuously during speaking, when sounds of different kinds are produced. Similarly, the diameters and areas of the discrete cylinders C1 to C8 representing the various parts of the vocal tract also vary during speaking. However, a previous Finnish patent application FI-912088 of this same inventor discloses that the average shape of the vocal tract calculated from a relatively high number of instantaneous vocal tract shapes is a constant characteristic of each speaker, which constant may be used for a more compact transmission of sounds in a telecommunication system or for recognizing the speaker. Correspondingly, the averages of the cross-sectional areas of the cylinder portions C1 to C8 calculated in the long term from the instantaneous values of the cross-sectional areas of the cylinders C1 to C8 of the lossless tube model of the vocal tract are also relatively exact constants. Furthermore, the values of the cross-sectional dimensions of the cylinders are also determined by the values of the actual vocal tract and are thus relatively exact constants characteristic of the speaker.

The method according to the invention utilizes so-called reflection coefficients produced as a provisional result at Linear Predictive Coding (LPC) well-known in the art, i.e. so-called PARCOR-coefficients $r_k$ having a certain connection with the shape and structure of the vocal tract. The connection between the reflection coefficients $r_k$ and the areas $A_k$ of the cylinder portions $C_k$ of the lossless tube model of the vocal tract is according to the formula (1)

$$-r(k) = \frac{A(k+1) - A(k)}{A(k+1) + A(k)} \tag{1}$$

where k=1, 2, 3, . . . . Such a cross-sectional area can be considered as a characteristic of a reflection coefficient.

The LPC analysis producing the reflection coefficients used in the invention is utilized in many known speech coding methods. One advantageous embodiment of the method according to the invention is expected to be coding of speech signals sent by subscribers in radio telephone systems, especially in the Pan-European digital radio telephone system GSM. The GSM Specification 06.10 defines very accurately the LPC-LTP-RPE (Linear Predictive Coding—Long Term Prediction—Regular Pulse Excitation) speech coding method used in the system. It is advantageous to use the method according to the invention in connection with this speech coding method, because the reflection coefficients needed in the invention are obtained as a provisional result from the above-mentioned prior art LPC-RPE-LTP coding method. In the invention, the steps of the method follow the speech coding algorithm complying with the GSM Specification 06.10 up to the calculation of the reflection coefficients, and as far as the details of these steps are concerned, reference is made to said GSM specification. In the following, these method steps will be described only generally in those parts which are essential for the understanding of the invention with reference to the flow chart of FIG. 4.

Figure 4:
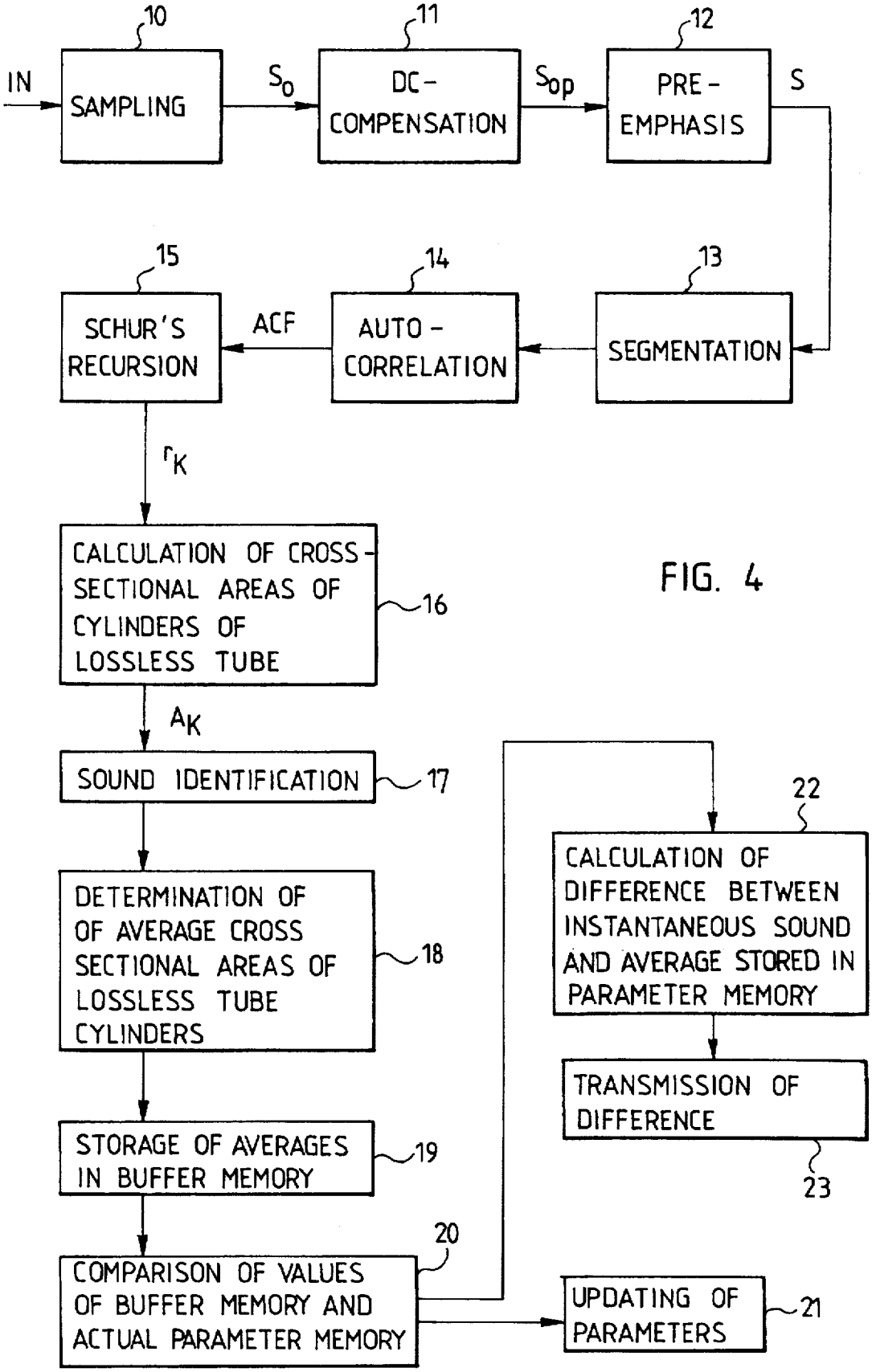
FIG. 4 shows a flow chart illustrating identification of sounds.

In FIG. 4, an input signal IN is sampled in block 10 at a sampling frequency 8 kHz, and an 8-bit sample sequence $s_o$ is formed. In block 11, a DC component is extracted from the samples so as to eliminate an interfering side tone possibly occurring in coding. After this, the sample signal is pre-emphasized in block 12 by weighting high signal frequencies by a first-order FIR (Finite Impulse Response) filter. In block 13 the samples are segmented into frames of 160 samples, the duration of each frame being about 20 ms.

In block 14, the spectrum of the speech signal is modelled by performing an LPC analysis on each frame by an auto-correlation method, the performance level being p=8. p+1 values of the auto-correlation function ACF are then calculated from the frame by means of the formula (2) as follows:

$$ACF(k) = \sum_{i=1}^{160} s(i)s(i-k) \tag{2}$$

where k=0, 1, . . . , 8.

Instead of the auto-correlation function, it is possible to use some other suitable function, such as a co-variance function. The values of eight so-called reflection coefficients $r_k$ of a short-term analysis filter used in a speech coder are calculated from the obtained values of the auto-correlation function by Schur's recursion 15 or some other suitable recursion method. Schur's recursion produces new reflection coefficients every 20th ms. In one embodiment of the invention, the coefficients comprise 16 bits and their number is 8. By applying Schur's recursion 15 for a longer time, the number of the reflection coefficients can be increased, if desired.

Figure 6:
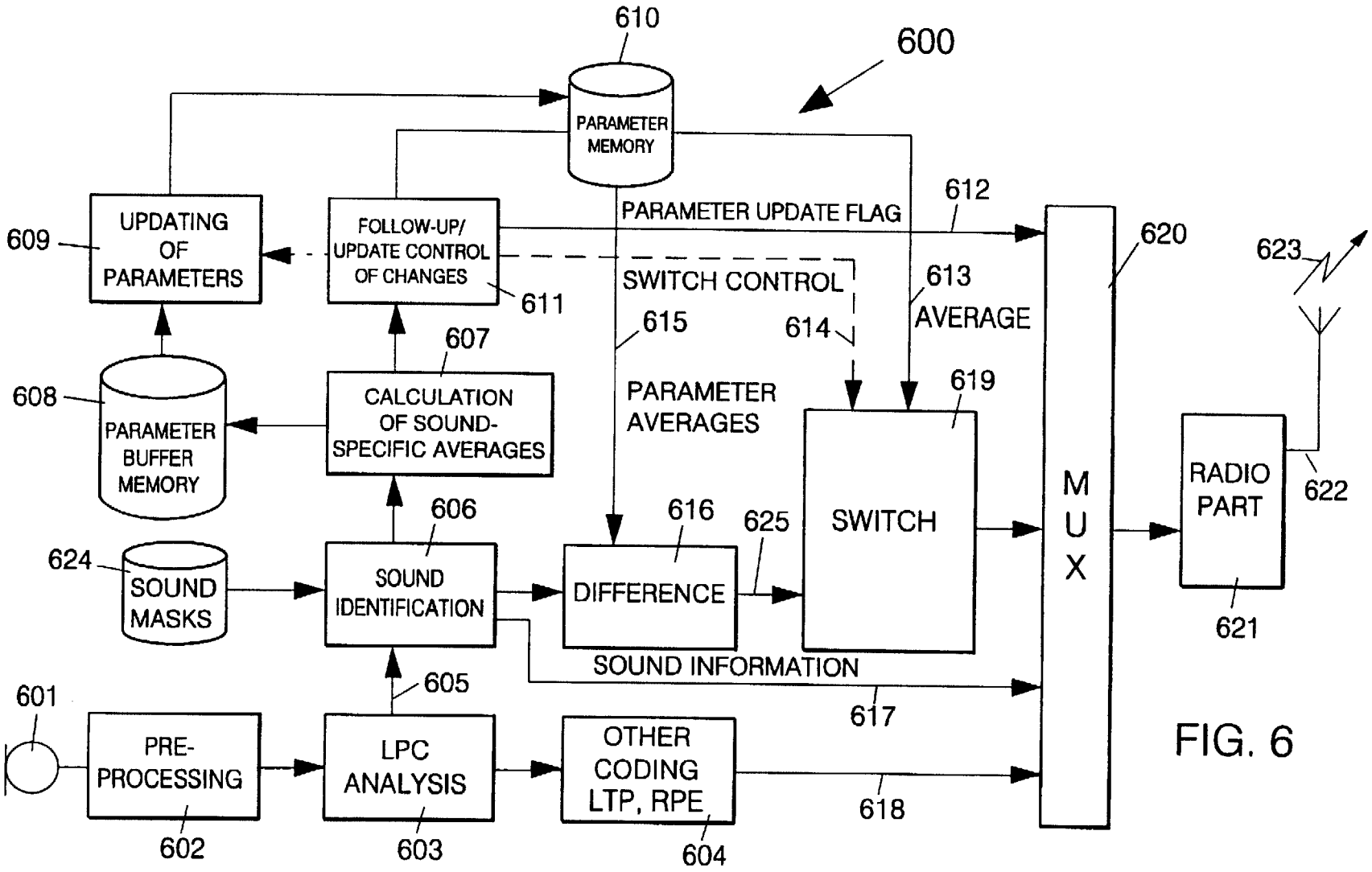
FIG. 6 shows a communications transmitter implementing the method according to the invention.
Figure 7:
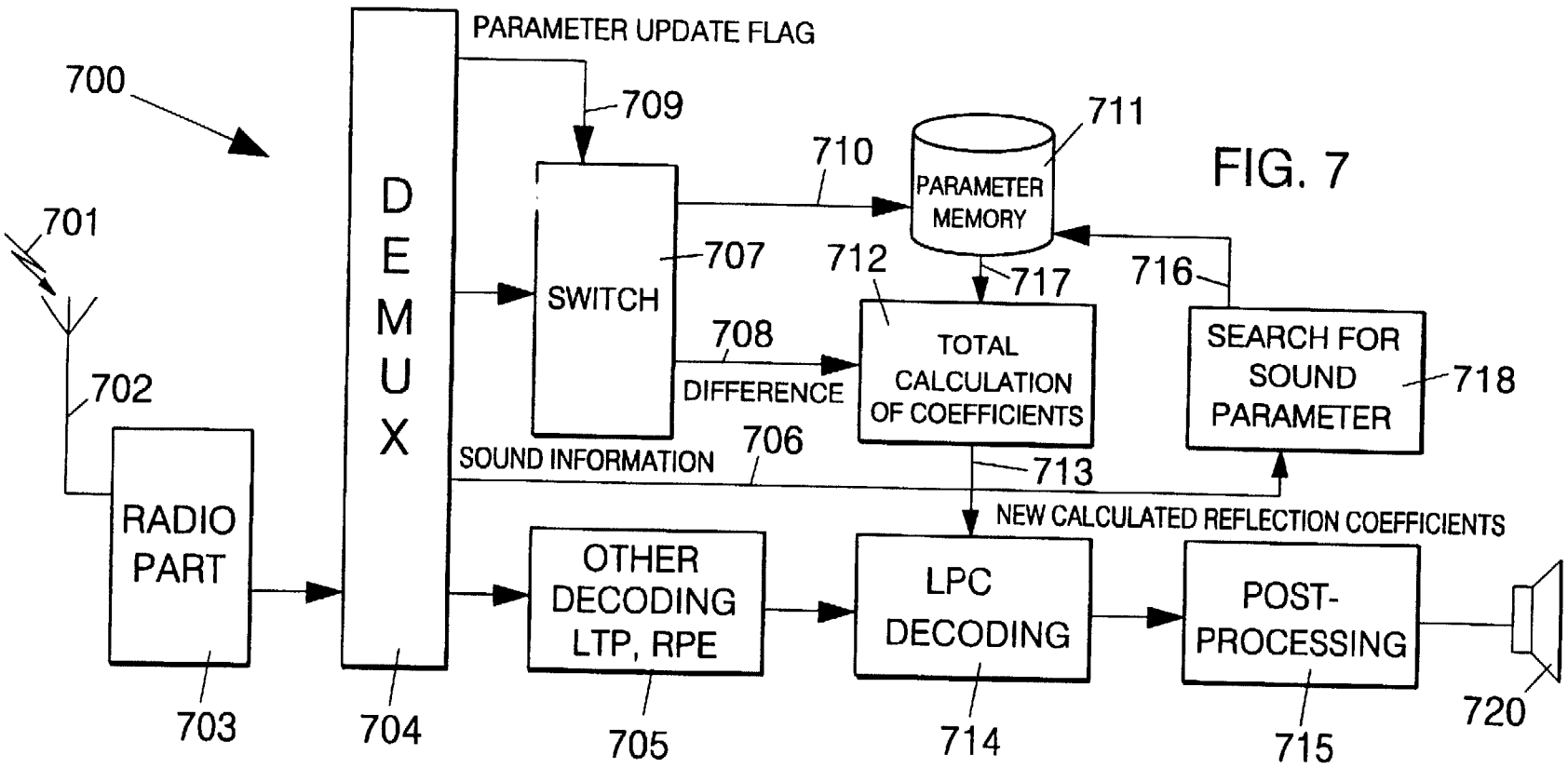
FIG. 7 shows a communications receiver implementing the method according to the invention.

In step 16, a cross-sectional area $A_k$ of each cylinder portion $C_k$ of the lossless tube modelling the speaker's vocal tract by means of the cylindrical portions is calculated from the reflection coefficients $r_k$ calculated from each frame. As Schur's recursion 15 produces new reflection coefficients every 20th ms, 50 cross-sectional areas per second will be obtained for each cylinder portion $C_k$. After the cross-sectional areas of the cylinders of the lossless tube have been calculated, the sound of the speech signal is identified in step 17 by comparing these calculated cross-sectional areas of the cylinders with the values of the cross-sectional areas of the cylinders stored in a parameter memory. This comparing operation will be presented in more detail in connection with the explanation of FIG. 5, referring to reference numerals 60, 60A and 61, 61A. In step 18, average values $A_{k,ave}$ of the areas of the cylinder portions $C_k$ of the lossless tube model are calculated for a sample taken of the speech signal, and the maximum cross-sectional area $A_{k,max}$ occurred during the frames is determined for each cylinder portion $C_k$. Then, in step 19, the calculated averages are stored in a memory, e.g. in a buffer memory 608 for parameters, shown in FIG. 6. Subsequently, the averages stored in the buffer memory 608 are compared with the cross-sectional areas of the just obtained speech samples, in which comparison is calculated whether the obtained samples differ too much from the previously stored averages. If the obtained samples differ too much from the previously stored averages, an updating 21 of the parameters, i.e. the averages, is performed, which means that a follow-up and update block 611 of changes controls a parameter update block 609 in the way shown in FIG. 6 to read the parameters from the parameter buffer memory 608 and to store them in a parameter memory 610. Simultaneously, those parameters are transmitted via a switch 619 to a receiver, the structure of which is illustrated in FIG. 7. On the other hand, if the obtained samples do not differ too much from the previously stored averages, the parameters of an instantaneous speech sound obtained from the sound identification shown in FIG. 6 are supplied to a subtraction means 616. This takes place in step 22 of FIG. 4, in which the substraction means 616 searches in the parameter memory 610 for the averages of the previous parameters representing the same sound and subtracts from them the instantaneous parameters of the just obtained sample, thus producing a difference, which is transmitted 625 to the switch 619 controlled by the follow-up and update block 611 of changes, which switch sends forward the difference signal via a multiplexer 620 MUX to the receiver in step 23. This transmission will be described more accurately in connection with the explanation of FIG. 6. The follow-up and update block 611 of changes controls the switch 619 to connect the different input signals, i.e. the updating parameters or the difference, to the multiplexer 620 and a radio part 621 in a way appropriate in each case.

Figure 3:
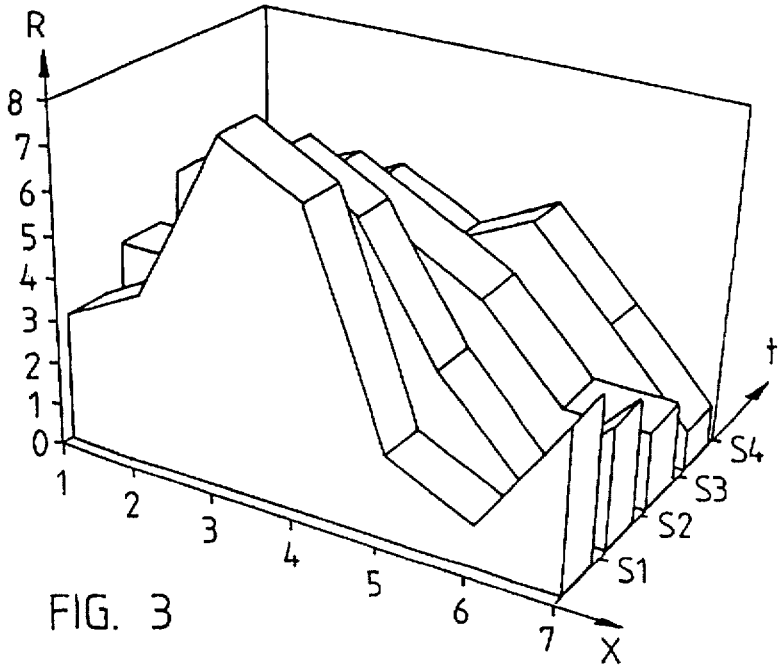
FIG. 3 illustrates how the lossless tube models change during speech.
Figure 5A:
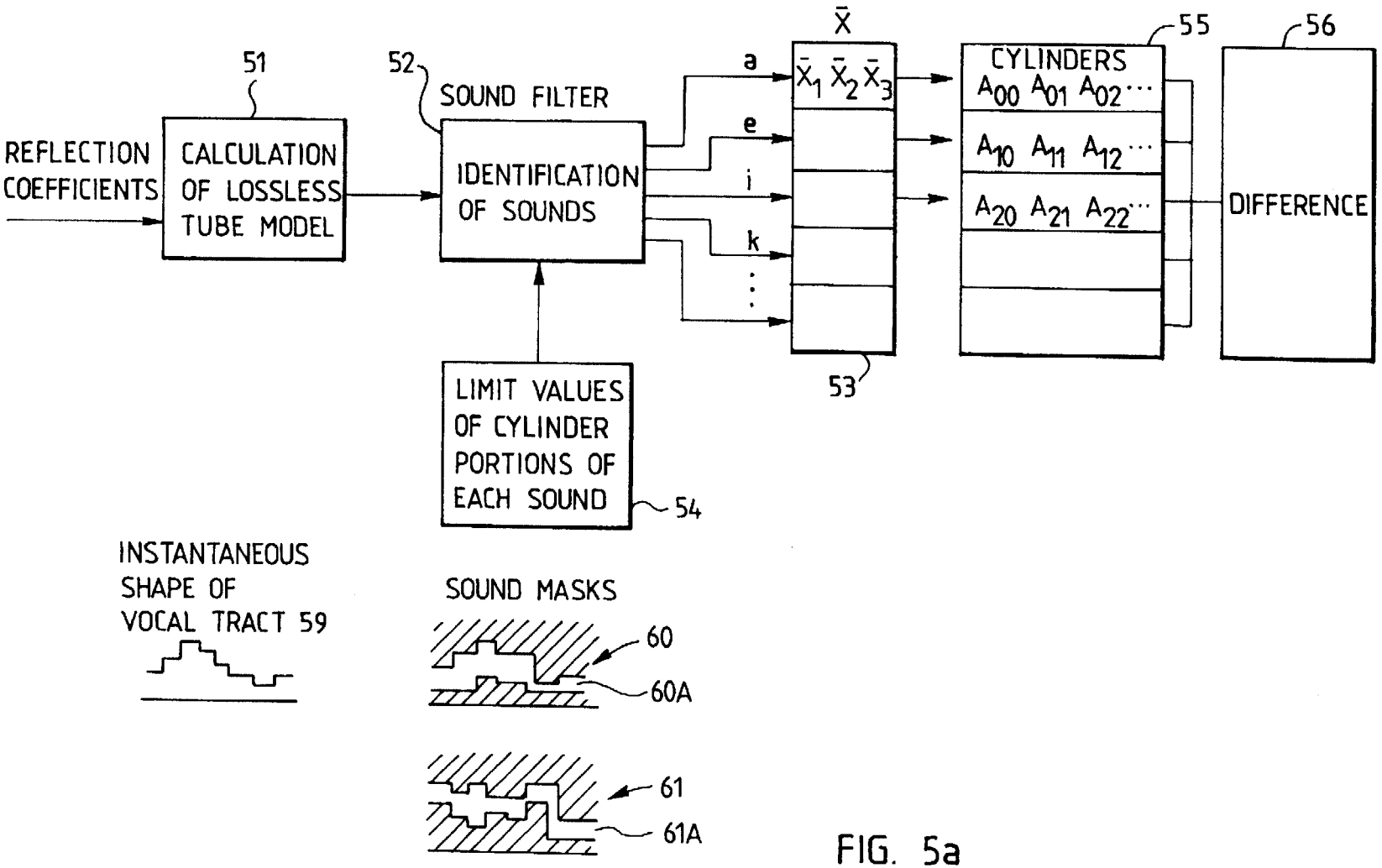
FIG. 5*a* is a block diagram illustrating speech coding on a sound level in a transmitter according to the invention.

In the embodiment of the invention shown in FIG. 5*a*, the analysis used for speech coding on a sound level is described in such a way that the averages of the cross-sectional areas of the cylinder portions of the lossless tube modelling the vocal tract are calculated from a speech signal to be analyzed, from the areas of the cylinder portions of instantaneous lossless tube models created during a predetermined sound. The duration of one sound is rather long, so that several, even tens of temporally consecutive lossless tube models can be calculated from a single sound present in the speech signal. This is illustrated in FIG. 3, which shows four temporally consecutive instantaneous lossless tube models S1 to S4. From FIG. 3 can be seen clearly that the radii and cross-sectional areas of the individual cylinders of the lossless tube vary in time. For instance, the instantaneous models S1, S2 and S3 could roughly classified be created during the same sound, so that their average could be calculated. The model S4, instead, is clearly different and associated with another sound and therefore not taken into account in the averaging.

In the following, speech coding on a sound level will be described with reference to the block diagram of FIG. 5*a*. Even though speech coding can be made by means of a single sound, it is reasonable to use in the coding all those sounds the communicating parties wish to send to each other. All vowels and consonants can be used, for instance.

The instantaneous lossless tube model 59 created from a speech signal can be identified in block 52 to correspond to a certain sound, if the cross-sectional dimension of each cylinder portion of the instantaneous lossless tube model 59 is within the predetermined stored limit values of the corresponding sound of a known speaker. These sound-specific and cylinder-specific limit values are stored in a so-called quantization table 54 creating a so-called sound mask included in a memory means indicated by the reference numeral 624 in FIG. 6. In FIG. 5*a*, the reference numerals 60 and 61 illustrate how said sound- and cylinder-specific limit values create a mask or model for each sound, within the allowed area 60A and 61A (unshadowed areas) of which the instantanaous vocal tract model 59 to be identified has to fit. In FIG. 5*a*, the instantaneous vocal tract model 59 fits the sound mask 60, but does obviously not fit the sound mask 61. Block 52 thus acts as a kind of sound filter, which classifies the vocal tract models into correct sound groups a, e, i, etc. After the sounds have been identified in block 606 of FIG. 6, i.e. in step 52 of FIG. 5*a*, the parameters corresponding to the identified sounds a, e, i, k are stored in the buffer memory 608 of FIG. 6, to which memory corresponds block 53 of FIG. 5*a*. From this buffer memory 608, or block 53 of FIG. 5*a*, the sound parameters are stored further under the control of the follow-up and update control block of changes of FIG. 6 in an actual parameter memory 55, in which each sound, such as a, e, i, k, has parameters corresponding to that sound. At the identification of sounds, it has also been possible to provide each sound to be identified with an identifier, by means of which the parameters corresponding to each instantaneous sound can be searched for in the parameter memory 55, 610. These parameters can be supplied to the subtraction means 616, which calculates 56 according to FIG. 58 the difference between the parameters of the sound searched for in the parameter memory by means of the sound identifier and the instantaneous values of this sound. This difference will be sent further to the receiver in the manner shown in FIG. 6, which will be described in more detail in connection with the explanation of that figure.

Figure 5B:
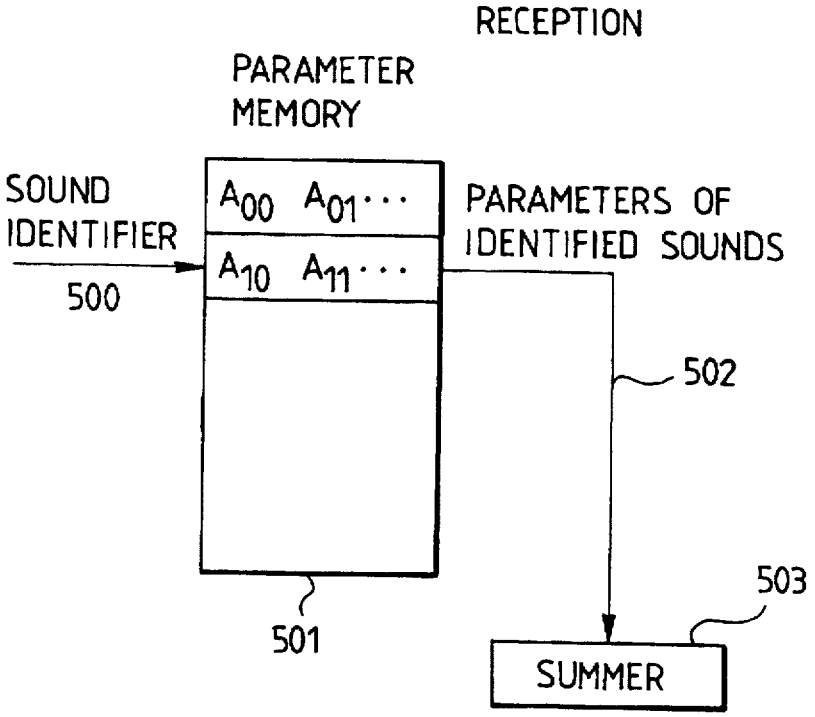
FIG. 5*b* shows a transaction diagram illustrating a reproduction of a speech signal on a sound level in a receiver according to the invention.

FIG. 5*b* is a transaction diagram illustrating a reproduction of a speech signal on a sound level according to the invention, taking place in a receiver. The receiver receives an identifier 500 of a sound identified by a sound identification unit (reference numeral 606 in FIG. 6) of the transmitter and searches in its own parameter memory 501 (reference numeral 711 in FIG. 7), on the basis of the sound identifier 500, for the parameters corresponding to the sound and supplies 502 them to a summer 503 (reference numeral 712 in FIG. 7) creating new characteristics of reflection coefficients by summing the difference and the parameters. By means of these numbers are calculated new reflection coefficients, from which can be calculated a new speech signal. Such a creation of speech signal by summing will be described in greater detail in the explanation related to FIG. 7.

FIG. 6 shows a communications transmitter 600 implementing the method of the invention. A speech signal to be transmitted is supplied to the system via a microphone 601, from which the signal converted into electrical form is transmitted to a preprocessing unit 602, in which the signal is filtered and converted into digital form. Then, an LPC analysis of the digitized signal is performed in an LPC analyzer 603, typically in a signal processor. The LPC analysis results in reflection coefficients 605, which are led to the transmitter according to the invention. The rest of the information passed through the LPC analyzer is supplied to other signal processing units 604, performing the other necessary codings, such as LTP and RPE codings. The reflection coefficients 605 are supplied to a sound identification unit 606 comparing the instantaneous cross-sectional values of the vocal tract of the speaker creating the sound in question, which values are obtained from the reflection coefficients of the supplied sound, or other suitable values, an example of which is indicated by the reference numeral 59 in FIG. 5, with the sound masks of the available sounds stored already earlier in a memory means 624. These masks are designated by the reference numerals 60, 60A, 61 and 61A in FIG. 5. After the sounds uttered by the speaker have been successfully discovered from the information 605 supplied to the sound identification unit 606, averages corresponding to each sound are calculated for this particular speaker in a sound-specific averaging unit 607. The sound-specific averages of the cross-sectional values of the vocal tract of that speaker are stored in a parameter buffer memory 608, from which a parameter update block 609 stores the average of each new sound in a parameter memory 610 at updating of parameters. After the calculation of the sound-specific averages, the values corresponding to each sound to be analyzed, i.e. the values from the temporally unbroken series of which the average was calculated, are supplied to a follow-up and update control block 611 of changes. That block compares the average values of each sound stored in the parameter memory 610 with the previous values of the same sound. If the values of a just arrived previous sound differ sufficiently from the averages of the previous sounds, an updating of the parameters, i.e. averages, is at first performed in the parameter memory, but these parameters, being the averages of the cross-sections of the vocal tract needed for the production of each sound, i.e. the averages 613 of the parameters, are also sent via a switch 619 to a multiplexer 620 and from there via a radio part 621 and an antenna 622 to a radio path 623 and further to a receiver. In order to inform the receiver of the fact that the information sent by the transmitter consists of updating information of parameters, the follow-up and update control block 611 of changes sends to the multiplexer 620 a parameter update flag 612, which is transmitted further to the receiver along the route 621, 622, 623 described above.

The switch 619 is controlled 614 by the follow-up and update control block 611 in such a way that the parameters pass through the switch 619 further to the receiver, when they are updated.

When new parameters have been sent to the receiver in a situation in which the communication has started, meaning that no parameters have been sent to the receiver earlier, or when new parameters replacing the old parameters have been sent to the receiver, a transmission of coded sounds begins at the arrival of next sound. The parameters of the sound identifed in the sound identification unit 606 are then transmitted to the subtraction means 616. Simultaneously, an information of the sound 617 is transmitted via the multiplexer 620, the radio part 621, the antenna 622 and the radio path 623 to the receiver. This sound information may be for instance a bit string representing a fixed binary number. In the subtraction means 616, the parameters of the sound just indentified at 606 are substracted from the averages 615 of the previous parameters representing the same sound, which averages have been searched for in the parameter memory 610, and the calculated difference is transmitted 625, via the multiplexer 620 along the route 621, 622, 623 described above, further to the receiver. An attentive reader observes that the advantage obtained by the method of the invention, i.e. a reduction in the needed transmission capacity, is based on this very difference produced by subtraction and on the transmission of this difference.

FIG. 7 shows a communications receiver 700 implementing the method of the invention. A signal transmitted by the communications transmitter 600 of FIG. 6 via a radio path 623=701 or some other medium is received by an antenna 702, from which the signal is led to a radio part 703. If the signal sent by the transmitter 600 is coded in another way than by LPC coding, it is received by a demultiplexer 704 and transmitted to a means 705 for other decoding, i.e. LTP and RPE decoding. The sound information sent by the transmitter 600 is received by the demultiplexer 704 and transmitted 706 to a sound parameters searching unit 718. The information of updated parameters is also received by the demultiplexer 704 DEMUX and led to a switch 707 controlled by a parameter update flag 709 received in the same way. A subtraction signal sent by the transmitter 600 is also applied to the switch 707. The switch 707 transmits 710 the information of updated parameters, i.e. the new parameters corresponding to the sounds, to a parameter memory 711. The received difference between the averages of the sound just arrived and the previous parameters representing the same sound is transmitted 708 to a summer 712. The sound identifier, i.e. the sound information, was thus transmitted to the sound parameters searching unit 718 searching 716 for the parameters corresponding to (the identifier of) the sound stored in the parameter memory 711, which parameters are transmitted 717 by the parameter memory 711 to the summer 712 for the calculation of the coefficients. The summer 712 sums the difference 708 and the parameters obtained 717 from the parameter memory 711 and calculates from them new coefficients, i.e. new reflection coefficients. By means of these coefficients is created a model of the vocal tract of the original speaker and speech is thus produced resembling the speech of this original speaker. The new calculated reflection coefficients are transmitted 713 to an LPC decoder 714 and further to a postprocessing unit 715 performing a digital/analog conversion and applying the amplified speech signal further to a loudspeaker 720, which reproduces the speech corresponding to the speech of the original speaker.

The above described method according to the invention can be implemented in practice, for instance by means of software, by utilizing a conventional signal processor.

The drawings and the explanation associated with them are only intended to illustrate the idea of the invention. As to the details, the method of the invention of transmitting and receiving coded speech may vary within the scope of the claims. Though the invention has above been described primarily in connection with radio telephone systems, especially the GSM mobile phone system, the method of the invention can be utilized also in telecommunication systems of other kinds.

I claim:

1. A method of transmitting coded speech, comprising the steps of:

storing in a memory sound-specific characteristics of reflection coefficients of one or several first speakers from respective first samples for later identification of sounds and respective sound identifiers;

taking second samples of a speech signal of a second speaker;

calculating reflection coefficients of the second speaker from said second samples;

calculating characteristics of the reflection coefficients from said reflection coefficients of said second speaker;

comparing said characteristics of said reflection coefficients of said second speaker with respective stored sound-specific characteristics of said reflection coefficients of said one or several first speakers, for identifying said sounds and respective sound identifiers;

transmitting said sound identifiers of said identified sounds, calculating averages of the reflection coefficients for the reflection coefficients of said one or several first speakers for a given sound;

storing said averages in said memory;

calculating second speaker-specific averages of the reflection coefficients, for the reflection coefficients representing a same sound as said given sound;

storing in said memory said second speaker-specific averages for the reflection of coefficients representing same sound;

comparing said calculated averages of the reflection coefficients of said one or several first speakers representing said given sound, as stored in said memory, with said averages of said reflection coefficients of said second speaker representing said same sound;

if the averages of the reflection coefficients representing said same sound of said second speaker differ essentially from said averages of the reflection coefficients of said one or several first speakers as stored in said memory, storing said averages representing the same sound of said second speaker in said memory as new averages, transmitting information that said new averages are to be transmitted; and transmitting said new averages representing said same sound, if said averages of the reflection coefficients of said second speaker representing said same sound differ essentially from said averages of the reflection coefficients of said one or several first speakers stored in said memory; and if said averages of the reflection coefficients of said second speaker representing same sound do not essentially differ from said averages of the reflection coefficients of the one or several first speakers is stored in said memory, calculating differences between the averages of the reflection coefficients representing the same sound of the second speaker and the averages of the reflections coefficients calculated from said first samples of said one or several first speakers, and transmitting said differences between the averages of the reflection coefficients representing the same sound of the second speaker and the averages of the reflection coefficients calculated from said samples of the one or several first speakers.

2. A method of receiving coded speech, comprising the steps of:

receiving a sound identifier of an identified sound;

receiving differences between averages of stored sound-specific reflection coefficients of one or several first speakers and averages of the reflection coefficients calculated from samples of speech of a second speaker;

searching for second speaker-specific averages of the reflection coefficients corresponding to the received sound identifier in a memory;

adding the second speaker-specific averages of the reflection coefficients corresponding to the received sound identifier to said differences, thereby generating a sum;

calculating from said sum new averages to be used for sound production; and upon reception of information of a transmission of new averages sent by a communications transmitter as well as new averages of the reflection coefficients representing the same sound sent by another communications transmitter storing these new averages in said memory.

* * * * *